US005167085A

United States Patent [19]

Yang

[11] Patent Number: 5,167,085

[45] Date of Patent: Dec. 1, 1992

[54] PICTURE FRAME ASSEMBLY

[76] Inventor: H. J. Yang, 7F, No. 18, 313 Lane, Charng-Ann St.,, Lu-Jou Country, Taipei Hsien, Taiwan

[21] Appl. No.: 861,006

[22] Filed: Mar. 31, 1992

[51] Int. Cl.[5] ..... A47B 1/06

[52] U.S. Cl. ..... 40/152; 40/152.1; 40/600

[58] Field of Search ..... 40/152, 152.1, 600

[56] References Cited

U.S. PATENT DOCUMENTS

| | | | |
|---|---|---|---|
| 540,011 | 5/1895 | Wiederer | 40/152.1 |
| 1,309,183 | 7/1919 | Cochrone | 40/152 |
| 2,419,187 | 4/1947 | Jolloy | 40/152 |
| 3,529,374 | 9/1970 | Spertus | 40/152 |

FOREIGN PATENT DOCUMENTS

| | | | |
|---|---|---|---|
| 1341268 | 12/1973 | United Kingdom | 40/152 |

*Primary Examiner*—Kenneth J. Dorner
*Assistant Examiner*—Cassandra L. Hope
*Attorney, Agent, or Firm*—Morton J. Rosenberg; David I. Klein

[57] ABSTRACT

A picture frame assembly comprising a folder having two rectangular flanges on two symmetrical face panels thereof to hold two picture-frames respectively, wherein the rectangular flanges each comprises at least one L-shaped notch on a peripheral side edge thereof, and a magnet on a top cross wall thereof for holding either picture-frame; the picture-frames each comprises at least one tenon on a peripheral edge thereof respectively inserted in the at least one L-shaped notch on either rectangular frame, and an iron plate on a back surface adjacent to a top edge thereof attracted by the magnet.

1 Claim, 3 Drawing Sheets

PICTURE FRAME ASSEMBLY

BACKGROUND OF THE INVENTION

The present invention relates to picture-frames, and more particularly, the present invention relates to a picture frame assembly comprised of two symmetrical picture frames attached to a folder by means of inserting tenons into notches and by means of the effect of a magnetic force.

In designing a picture-frame, convenience in changing pictures has become an important factor to attract people to buy. This is the common shortcoming of the known picture-frames.

The present invention has been accomplished to eliminate the aforesaid disadvantage. It is therefore an object of the present invention to provide a picture frame assembly which is can be conveniently disassembled for inserting or changing a picture. It is another object of the present invention to provide a picture frame assembly which is durable in use. According to one aspect, a picture frame assembly is generally comprised of a folder having two rectangular flanges on two symmetrical face panels thereof to hold two picture-frames respectively, wherein each rectangular flange has at least one L-shaped notch on a peripheral side edge thereof for inserting at least one tenon on each frame. By inserting the at least one tenon into the at least one L-shaped notch or removing the at least one tenon from the at least one L-shaped notch, each frame can be conveniently attached to or removed from either face panel of the folder for inserting or changing a picture. According to another aspect of the present invention, a magnet is mounted on the top cross wall of each rectangular flange to attract an iron plate on the back surface adjacent of each frame, and therefore, each frame can be firmly respectively secured to each rectangular flange through a magnetic force.

DETAILED DESCRIPTION OF THE PREFERRED EMBODIMENT

Figure 1:
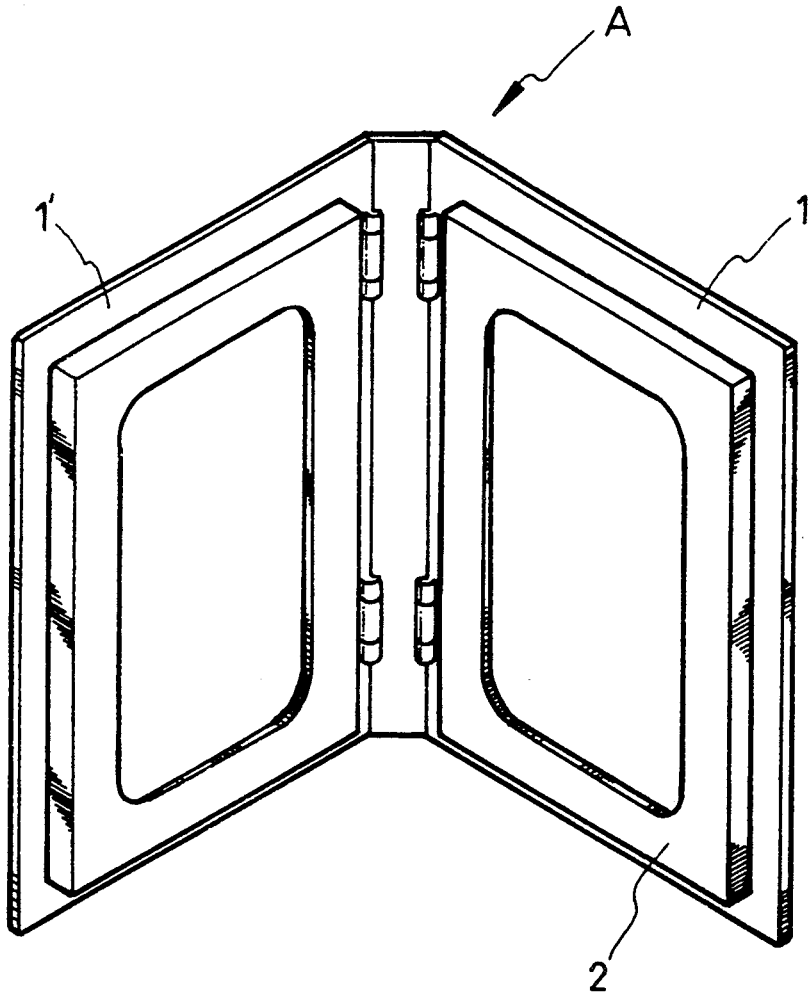
FIG. 1 is an elevational view of a picture frame assembly embodying the present invention.
Figure 2:
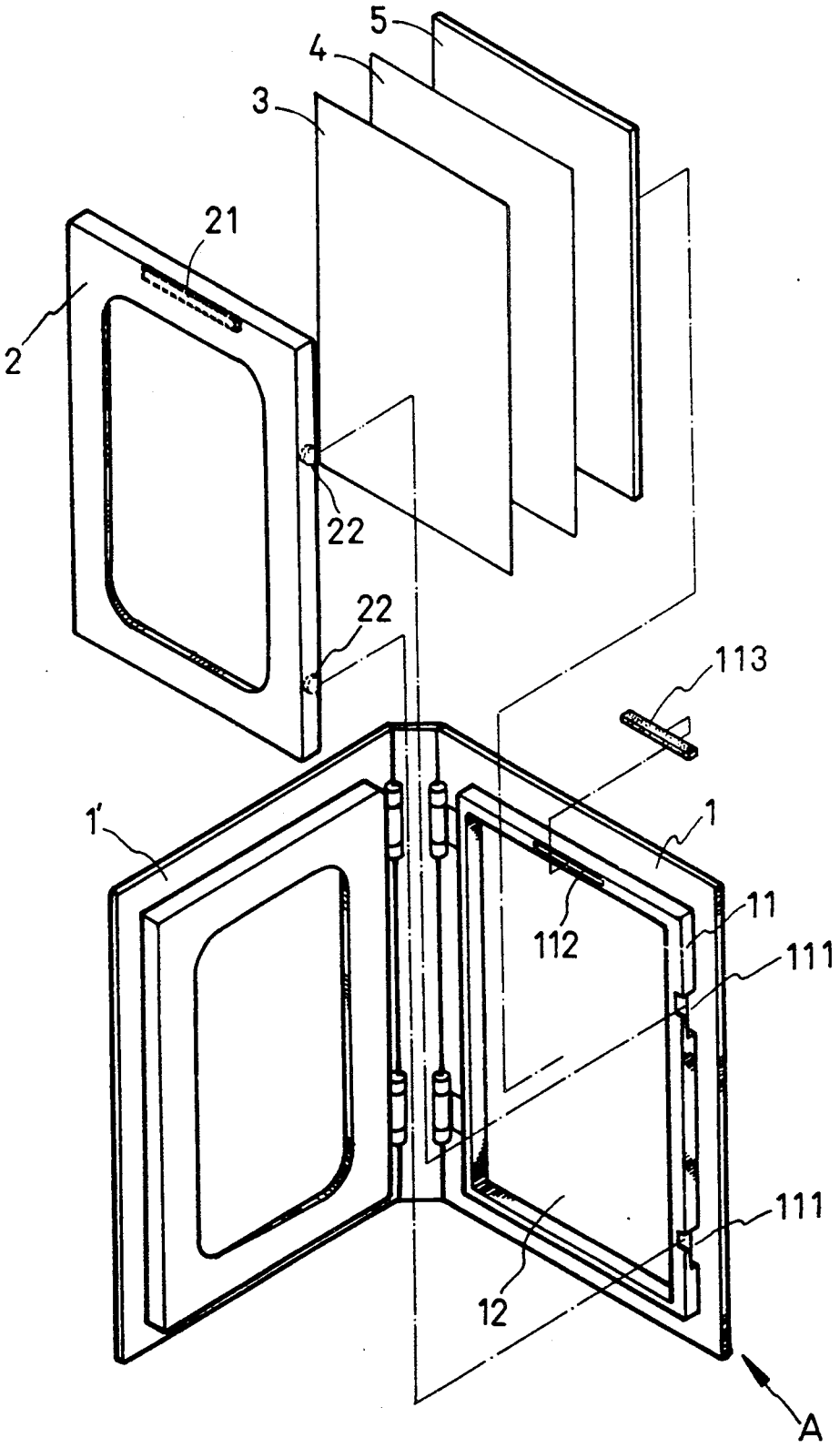
FIG. 2 is an exploded view thereof.

Referring to FIGS. 1, 2-1 and 2-2, a picture frame assembly is generally comprised of a folder A to hold picture-frames for showing pictures. The folder A is comprised of two symmetrically face panels 1 and 1' which have the same structure. The face panel 1 or 1' comprises a rectangular flange 11 with a space 12 defined therein for holding pictures. The rectangular flange 11 comprises at least one L-shaped notch 111 on the outer peripheral edge thereof (the L-shaped notch 111 is formed of a vertical opening vertically extending downwards from a horizontal opening at one end), and an elongated slot 112 on the top cross wall thereof for inserting a magnet 113. A frame 2 is mounted on each face panel 1 or 1' to hold a transparent cover board 3 and a back board 5 with a picture 4 retained therebetween for showing. The frame 2 comprises an iron plate 21 transversely attached to the inner face thereof at the top, and at least one tenon 22 at a location or locations corresponding to the at least one L-shaped notch 111 on either face panel 1 or 1'.

Figure 3:
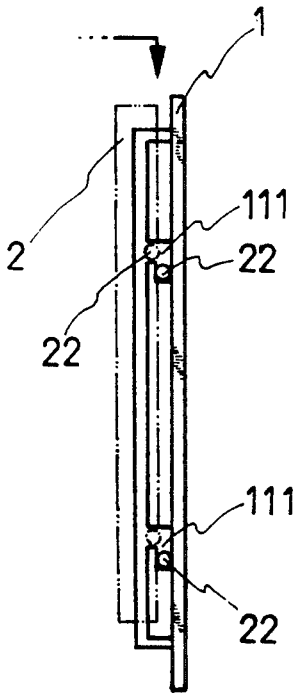
FIG. 3 is a schematic drawing showing the procedure in mounting a frame to either face panel by inserting the tenons on a frame into the L-shaped notches on the rectangular flange of a face panel.
Figure 4:
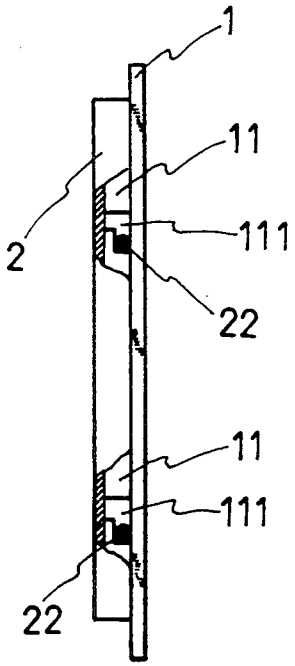
FIG. 4 illustrates that the tenons have been respectively inserted into the L-shaped notches.

Referring to FIGS. 3 and 4, when a transparent cover board 3, a back board 5 and a picture 4 are respectively inserted into the space 12 in the face panel 1 or 1', the frame 2 is attached to the face panel 1 or 1' permitting the at least one tenon 22 to be respectively inserted through the horizontal opening of each of the at least one L-shaped notch 111 into the vertical opening thereof. Once the frame 2 has been closely attached to the face panel 1 or 1' through a face mounting, the magnet 113 attracts the iron plate 12 causing the frame 2 to be firmly secured to the rectangular flange 11 in holding up the transparent cover board 3, the back board 5 and the picture 4. Moving the at least one tenon 22 from the at least one notch 111 in a reverse direction, the frame 2 can be conveniently detached from the face panel 1 or 1' of the folder A.

What is claimed is:

1. A picture frame assembly comprising a folder having two rectangular flanges extending from two symmetrically connecting face panels, respectively, and two rectangular picture-frames attached to said two flanges, respectively, and whereby said folder is characterized in that said rectangular flanges each comprises at least one L-shaped notch located on a peripheral side edge thereof and a magnet located on a top cross wall of each said flange for holding either said picture-frames; said picture-frame each comprising at least one tenon located on a peripheral edge thereof such that said tenon is inserted in the at least one L-shaped notch on either rectangular frame when the picture frame is mounted on the flanges, and an iron plate on a back surface adjacent to a top edge of the picture-frame which is attracted by said magnet when the picture frame is mounted on the flanges.

* * * * *